US009945137B2

(12) United States Patent
Prest

(10) Patent No.: US 9,945,137 B2
(45) Date of Patent: Apr. 17, 2018

(54) WRAPAROUND COVER FOR A STEP

(71) Applicant: J. David Prest, Chandler, AZ (US)

(72) Inventor: J. David Prest, Chandler, AZ (US)

(73) Assignee: PREST-O-FIT MANUFACTURING, INC., Tempe, AZ (US)

( * ) Notice: Subject to any disclaimer, the term of this patent is extended or adjusted under 35 U.S.C. 154(b) by 0 days.

(21) Appl. No.: 15/015,380

(22) Filed: Feb. 4, 2016

(65) Prior Publication Data

US 2017/0226759 A1 Aug. 10, 2017

(51) Int. Cl.
*E04G 21/30* (2006.01)
*E04F 11/17* (2006.01)
*E04F 11/02* (2006.01)

(52) U.S. Cl.
CPC ..... *E04G 21/30* (2013.01); *E04F 11/17* (2013.01); *E04F 2011/0203* (2013.01)

(58) Field of Classification Search
CPC .... E04G 21/30; E04F 11/17; E04F 2011/0203
USPC ..... 248/345.1; 16/8, 4, 5, 10, 11, 16, 17.1; 15/215–217; 52/179, 180–182, DIG. 13; 24/179
See application file for complete search history.

(56) References Cited

U.S. PATENT DOCUMENTS 330,963 A * 11/1885 Dennis ..... E04F 11/17 16/10
815,391 A * 3/1906 Weinstock ..... E04F 11/17 16/10
1,844,539 A * 2/1932 Cathcard ..... A47G 27/06 16/11
3,093,216 A * 6/1963 Dunham ..... E04C 2/427 105/375
3,751,771 A * 8/1973 Vipond ..... A47C 31/023 16/16
4,457,398 A * 7/1984 Loix ..... E04F 11/025 182/151
6,088,976 A * 7/2000 Roy ..... A47G 27/0287 52/177
7,080,426 B2 * 7/2006 Roychowdhury ... A47G 27/065 16/10
7,513,519 B2 * 4/2009 Sharpe ..... A47L 23/26 280/163
2005/0251955 A1 * 11/2005 Roychowdhury ... A47G 27/065 16/10
2008/0254253 A1 * 10/2008 Gallager ..... A47G 27/0287 428/86
2014/0174005 A1 * 6/2014 Richard ..... E04F 11/175 52/179

* cited by examiner

*Primary Examiner* — Nkeisha Smith
(74) *Attorney, Agent, or Firm* — Von Hellens & Bycer Law; Matthew L. Bycer

(57) ABSTRACT

A wraparound cover for a step or a seat includes rods on opposed ends beneath the step and tie wraps engaging the rods through holes in the opposed ends to secure the cover to the step. Each opposed end may be bifurcated into two parts to accommodate a riser supporting the step. In such configuration, a rod and holes are formed at each of the parts to accommodate tie wraps for drawing the rods in opposed parts of the opposed ends toward one another to secure the wraparound cover about the step or the seat.

10 Claims, 3 Drawing Sheets

WRAPAROUND COVER FOR A STEP

BACKGROUND OF THE INVENTION

1. Field of the Invention

The present invention relates to step covers and, more particularly, to a wraparound step cover.

2. Description of Related Prior Art

Numerous types of step covers have been used over the years. The most common step cover is simply material, usually a rubber composition, which is attached to the top of a step by a mastic, brads, or the like. Such a cover may extend partially or fully along the top surface of the step. Some step covers wrap partially around a step such that the opposed edges of the cover extend onto the sides or bottom of the step and are attached by nails, brads, or a mastic. A potentially removable step cover extends partially about each longitudinal edge of a step and partially on to the bottom of the step. The opposing ends of the cover at the bottom of the step are latched with one another by cords or the like penetrably engaging apertures along the edges of the cover under the step.

The first two types of covers discussed above are usually permanently or at least semi-permanently attached to a step. This creates difficulties when the covers are to be replaced due to wear, damage or discoloration. The third type of cover is relatively easily removed but while in operation the forces exerted by the cords tend to cause a cover to pucker due to the non-uniform pulling forces exerted by the engaged cords. This puckering renders these types of covers relatively unsightly. If the pucker extends to the top of the step, a safety hazard exists as it may cause a user to trip.

Except for the first above-described cover, the other two types of covers do not lend themselves for use where the step is supported at the midpoint by a riser. That is, the presence of a riser extending for essentially the full width of the step essentially precludes wrapping the cover about the front and rear edges and attaching them to the bottom of the step. Thus, steps supported by a riser at or close to the midpoint of the step limits the use of a cover to the top surface of the step. Where such steps are of metal, attachment on a permanent or semi-permanent basis of a cover creates significant issues relating to attachment and covers are unlikely to be used.

SUMMARY OF THE INVENTION

The present invention is directed to a cover or rug for a step that extends across the top of the step with the longitudinal ends thereof extending along the front and back sides and partially onto the bottom of the step. In the event the step is supported by a riser at the midpoint thereof, the front and rear edges of the cover are split to extend along the bottom of the step on each side of the riser. The end of each front and rear edge of the cover supports a rod within a sleeve. A plurality of apertures are formed in each front and rear edge adjacent the corresponding rod. The front and rear edges of the cover are drawn toward one another to secure the cover in place by conventional plastic tie wraps engaging pairs of holes in the opposing ends of the cover. The tie wraps bear against the respective rods and thereby exert a pulling force along the full length of each corresponding opposed end. By tightening the tie wraps, sufficient friction exists between the cover and the step to prevent sliding movement of the cover along the step. Replacement of a cover is a simple matter of severing the tie wraps to disengage the old cover and removing it. The replacement cover is secured in place with new tie wraps.

It is therefore a primary object of the present invention to provide a detachably attached cover that extends along the top, sides and onto the bottom of a step.

Another object of the present invention is to provide a cover that wraps along the top and sides of a step and applying a uniform force exerted along opposing ends of the cover to draw them toward one another on the bottom of the step and retain the cover in place.

Still another object of the present invention is to provide a wraparound cover for a step having a rod disposed along each end of the cover beneath the step and drawn toward each other by multiple tie wraps engaging the rods.

A further object of the present invention is to provide a rod at each end of a wraparound cover for a step and tie wraps urging the rods toward one another to establish a uniform force along the length and width of the cover to retain it in place.

A yet further object of the present invention is to provide a rod at each end of a wraparound step cover for detachably attaching the rods to one another with tie wraps.

A yet further object of the present invention is to provide a wraparound cover having front and back split ends extending beneath a step to accommodate the presence of a riser and the use of tie wraps to engage rods at opposed paired ends on either side of the riser to draw the paired ends toward one another and secure the wraparound cover in place.

A still further object of the present invention is to provide a wraparound cover for a step supported in part by a centrally located riser by splitting the opposed ends of the wraparound cover into two paired ends and drawing the ends of each pair of ends toward one another by tie wraps engaging rods disposed at each end of each pair of ends.

A yet further object of the present invention is to provide a uniform force extending along the length of the ends of a wraparound cover disposed at the bottom of the step.

A yet further object of the present invention is to provide a method for drawing the ends of a wraparound cover at the bottom of a step with tie wraps engaging a rod disposed at each of the ends to exert a uniform force along the length of each of the ends.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
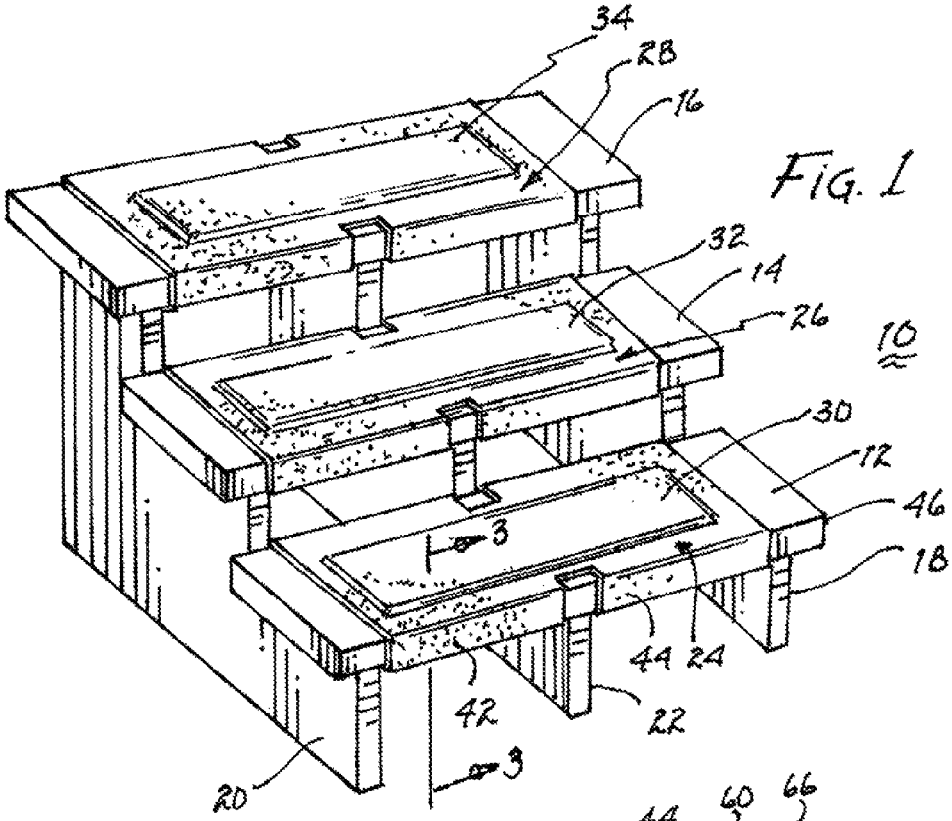
FIG. 1 illustrates a module of steps having a centrally located riser and illustrating the wraparound cover mounted on each step.

Referring to FIG. 1, there is illustrated a module 10 depicting a plurality of steps 12, 14 and 16 supported laterally by supports 18, 20 and a generally centrally located riser 22. Each of steps 12, 14 and 16 may include a rug or a wraparound cover 24, 26 and 28, respectively. A pad 30, 32 and 34 may be attached to the surface of the respective covers. To accommodate the presence of riser 22, the front and rear ends of each of the wraparound covers may be bifurcated to permit wrapping the wraparound cover about its respective step.

Figure 2:
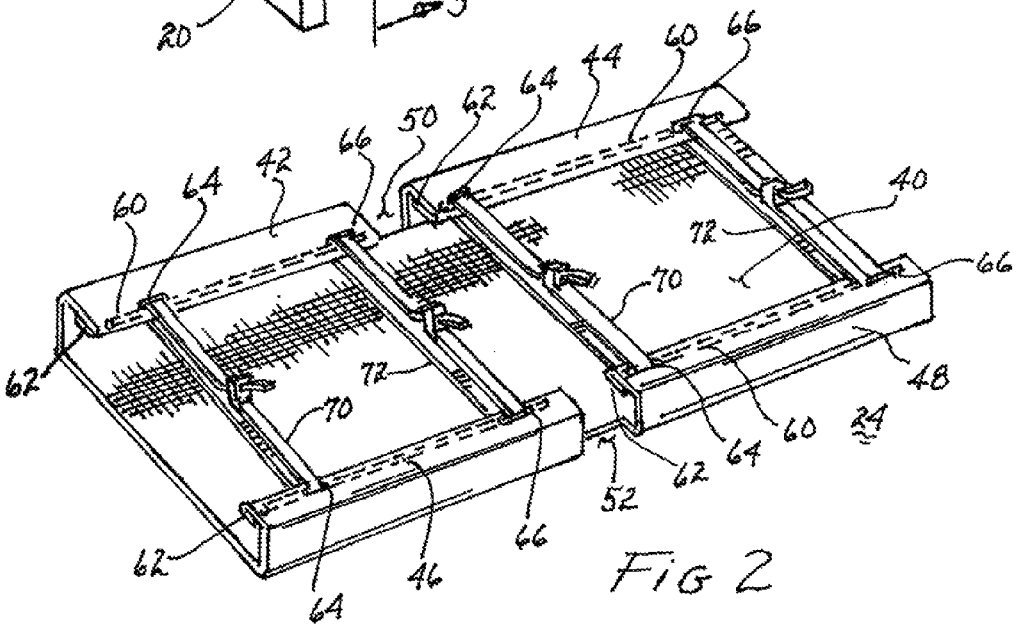
FIG. 2 illustrates the underside of the wraparound cover.

The underside of each wraparound cover is illustrated in FIG. 2. For purposes of illustration and disclosure, wraparound cover 24 is representative of the other wraparound covers shown in FIG. 1. Numeral 40 illustrates the underside of the portion of the wraparound cover 24 supported upon a step, such as step 12. Bifurcated ends 42 and 44 extend around front edge 46 of step 12, as illustrated in FIG. 1. Rear bifurcated end 46 extends around the rear edge of step 12 to the bottom of the step. Similarly, bifurcated end 48 extends around the rear edge of step 12 to the bottom of the step. As illustrated, a space 50 is present between bifurcated ends 42 and 44 to accommodate riser 22. Similarly, a space 52 exists between bifurcated ends 46 and 48 to also accommodate the riser.

A rod 60 is disposed within a sleeve 62 of bifurcated end 42. Apertures or holes 64, 66 penetrate sleeve 62 essentially adjacent the location of rod 60. A similar rod (60), sleeve (62) and holes (64,66) are disposed in each of remaining bifurcated ends 44, 46 and 48. For purposes of simplicity of numbering, these elements have common identifying numbers.

Each cover is retained in place by securing the paired bifurcated ends with one another. A conventional tie wrap 70 is looped through opposing holes 64. Another tie wrap 72 is looped through holes 66. Each of these tie wraps is drawn tightly to bring bifurcated ends toward one another. The forces exerted by tie wraps 70, 72 bear upon respective rods 60. These rods, being in their respective sleeve 62, translate the force urged by the tie wraps to essentially the full width of each bifurcated end. Thereby, there is no concentration of forces, such as would be present were grommets or the like, used and engaged by similar tie wraps. Furthermore, as each tie wrap can be tightened to a selective degree, the wraparound cover is firmly and essentially immovably attached to its corresponding step.

Figure 3:
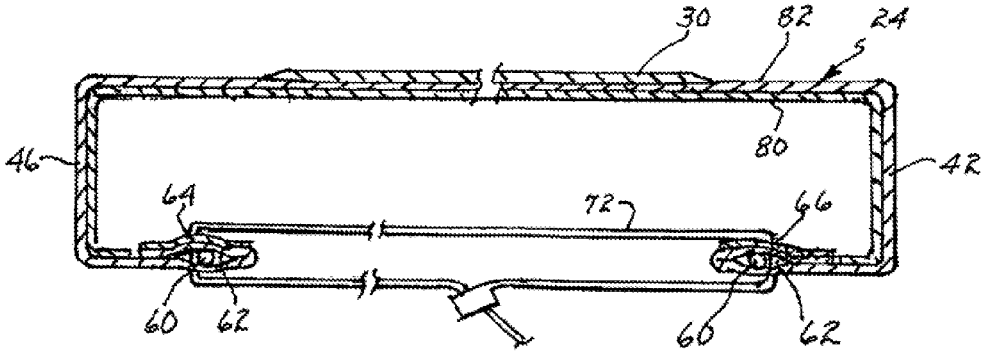
FIG. 3 is a cross-sectional view of the wraparound cover taken along lines 3-3, as shown in FIG. 1.

FIG. 3 illustrates a cross-section of a wraparound cover and its elements attached to a step. Cover 24 may include a backing 80 supporting nap 82 of the rug. A pad 30 may be lying on or otherwise attached to cover 24. Front bifurcated end 42 extends about the front of step 12 (see FIG. 1) and bifurcated end 46 extends about the rear of step 12. As described above, bifurcated end 42 includes a sleeve 62 within which is disposed rod 60. Similarly, bifurcated end 46 includes a sleeve 62 within which rod 60 is disposed. Tie wrap 72 extends through holes 66 and 64. By tightening tie wrap 72, a force will be exerted upon rods 60 to draw them toward one another. Upon such movement, the rods, bearing against the end of sleeves 64, 66, will draw wraparound cover 24 tightly about enclosed step 12 (see FIG. 1).

Figure 4:
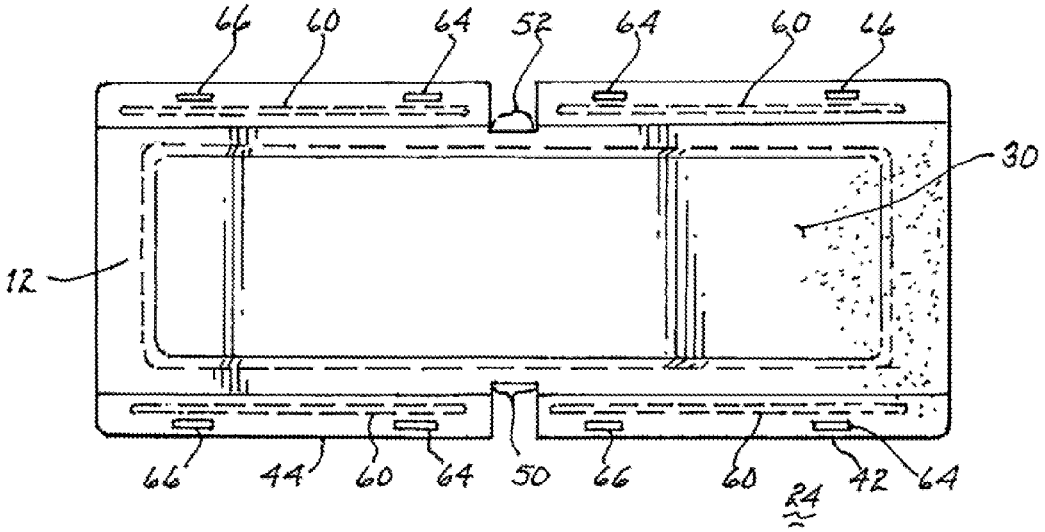
FIG. 4 illustrates a bottom view of the wraparound cover with the rods illustrated in dashed lines.

FIG. 4 is a bottom view of a wraparound cover, such as wraparound cover 24, without the tie wraps being attached thereto. In particular, it illustrates the various elements for using a wraparound cover upon a step essentially supported laterally and by a riser. Spaces 50, 52 disposed between the bifurcated ends accommodate the presence of the centrally located riser. It is to be understood that depending upon the length of the step to be covered, there may be more than one riser. In such event, the wraparound cover may include three or more pairs of bifurcated ends. Rods 60 are disposed in each bifurcated end within their respective sleeves, as described above. Pairs of holes 64, 66 are clearly illustrated essentially adjacent rods 60 as shown jointly in FIGS. 2 and 4. These pairs of holes are essentially adjacent the corresponding rod 60 and located laterally outwardly from the rod. Thereby, a force exerted by a tie wrap 72 (see FIG. 3) is caused to bear against the respective rod when the tie wrap is tightened.

Figure 5:
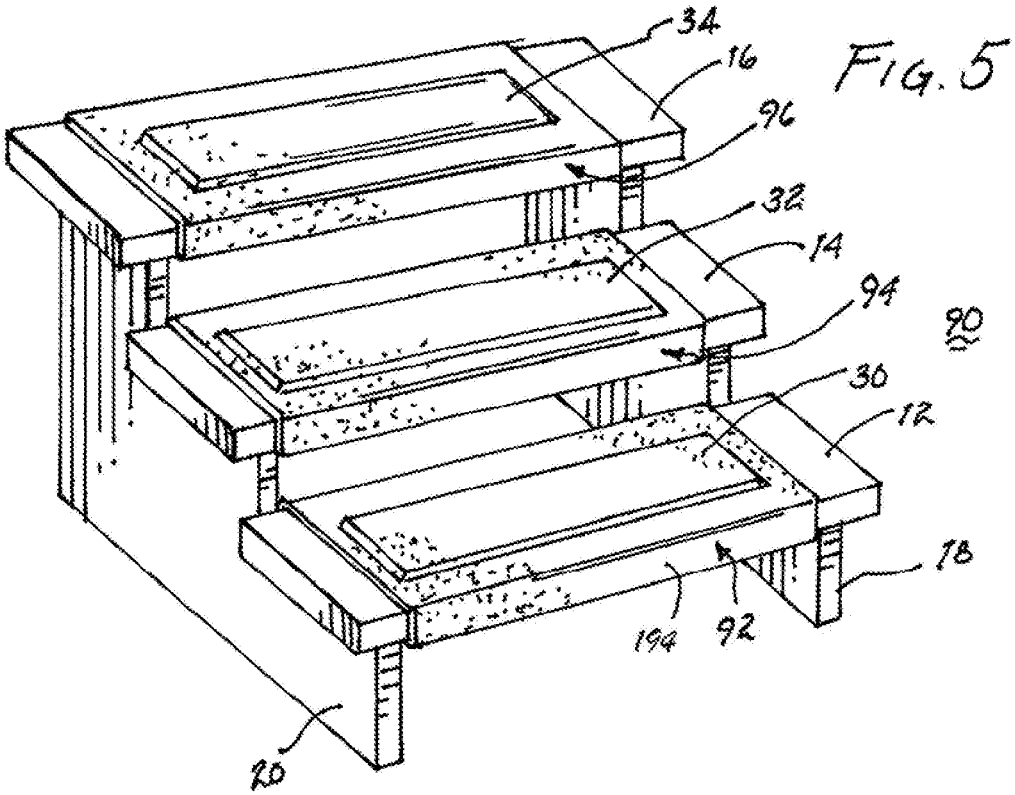
FIG. 5 illustrates a further module of steps supported at opposed ends and absent a riser.

FIG. 5 illustrates a module 90 that is essentially duplicative of module 10 shown in FIG. 1 except that a riser 22 is absent as being unnecessary to support the respective steps.

Figure 6:
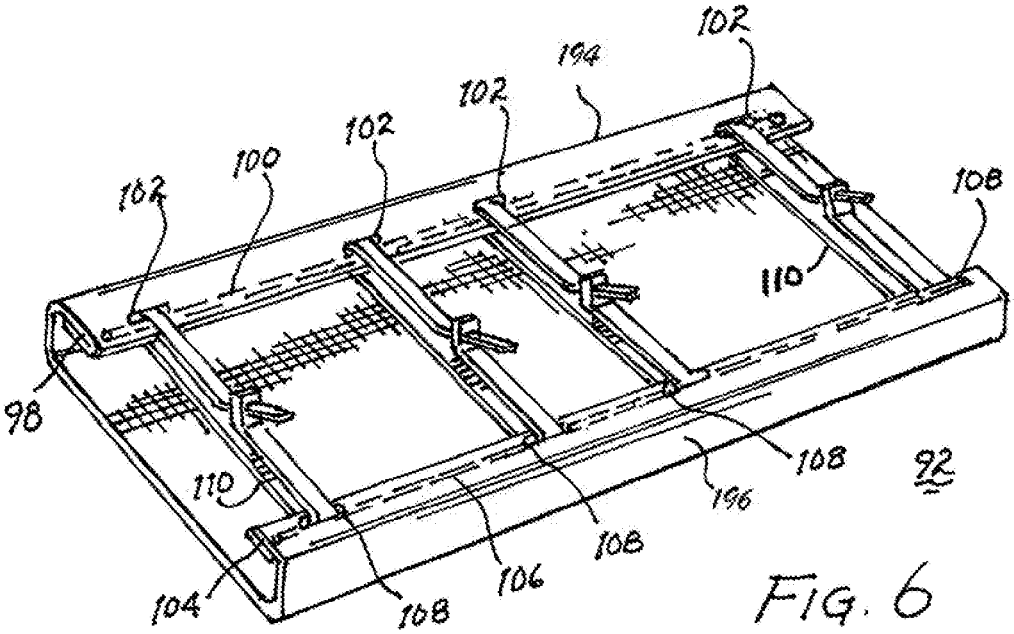
FIG. 6 illustrates the underside of the wraparound cover shown in FIG. 5.

Referring jointly to FIGS. 5 and 6, the features of module 90 which are different from the features of module 10, will be described. Other elements and functions will remain the same. Wraparound covers 92, 94 and 96 extend across respective steps 12, 14, and 6 without having front or rear ends bifurcated. As depicted in FIGS. 5 and 6, the front end of each wraparound cover 92, 94, 96 extends downwardly along the face of the respective step (12, 14, 16) and extends to a point beneath the step. Similarly, each rear end extends across the side of the respective step (12, 14, 16) to a location beneath the step. Front end 194 of the wraparound cover includes a full length sleeve 98 for retaining a rod 100 therewithin. A plurality of holes 102 extend through sleeve 98 forwardly of rod 100. Similarly, rear end 196 includes a full length sleeve 104 for supporting an essentially full length rod 106. A plurality of holes 108 extend through sleeve 104 to the rear of rod 106. Each of a plurality of tie wraps 110 engages a pair of holes 102, 108. When drawn tight, the tie wraps will draw rods 100, 106 toward one another and thereby exert a stretching force on wraparound cover 92 to secure the wraparound cover about the respective step (12, 14, 16).

As may be noted by inspection of modules 10 and 90, the use of the rods in sleeves at the front and rear ends of the wraparound cover apply a uniform force exerted by the tie wraps extending uniformly along the lengths of the front and rear ends of the wraparound cover. Thus, there is no concentration of forces, such as would be the case with use of grommets, or holes engaged by tie wraps or cords. Similarly, were snaps or other localized attachment means used to draw the front and rear ends toward one another, there would be a concentration of forces resulting in puckering and unsightliness of the wraparound cover.

I claim:

1. A wraparound cover for attachment to a step or a seat, said wraparound cover comprising:

(a) a cover extending across the step and having opposed ends foldable to an underside of the step;

(b) a first rod attached to a first one of said ends;

(c) a second rod attached to a second one of said ends;

(d) at least two holes formed in said first end adjacent said first rod;

(e) at least two additional holes formed in said second end adjacent said second rod; and (f) penetrating means for penetrating both of said at least two holes and both of said at least two additional holes for drawing said first and second rods toward one another to secure said wraparound cover about the step.

2. A wraparound cover as set forth in claim 1 wherein each end of said wraparound cover is split into two bifurcated ends to accommodate therebetween a riser for the step, each of said bifurcated ends including a bifurcated end rod and more than one hole formed in each of said bifurcated ends adjacent said bifurcated end rods and drawing means for drawing each of said bifurcated end rods in opposed ones of said bifurcated ends toward one another to secure said wraparound cover about the step.

3. A wraparound cover as set forth in claim 2 wherein said penetrating means comprises conventional tie wraps.

4. A wraparound cover as set forth in claim 2 wherein the end of each of said bifurcated ends is folded over into a sleeve to receive respective ones of said bifurcated end rods.

5. A wraparound cover as set forth in claim 1 wherein said penetrating means comprises conventional tie wraps.

6. A wraparound cover as set forth in claim 1 wherein the end of each of said first and second ends is folded over into a sleeve to receive respective ones of said first and second rods.

7. A wraparound rug for covering a step, said rug comprising:

(a) a cover extending across a top of the step and having opposed ends, a first end and a second end each of said first and second ends, positionable beneath the step;

(b) a first rod disposed at said first end; and a second rod disposed at said second end;

(c) a plurality of holes disposed at said first end adjacent said first rod; and a second plurality of holes disposed at said second end adjacent said second rod;

(d) engaging means each said engaging means for engaging one of each of said plurality of holes said engaging means to fasten to one of each of said second plurality of holes to bear against said first and second rods to draw said opposed ends toward one another and secure said rug about the step; and (e) securing means for securing said first rod to said first end; and a second securing means for securing said second rod to said second end.

8. A wraparound rug as set forth in claim 7 wherein said securing means comprises a folded over section of said first and second ends for receiving said first and second rods.

9. A wraparound rug for covering a step, said rug comprising:

(a) a cover extending across a top of the step and having opposed ends, a first end and a second end each of said first and second ends, positionable beneath the step;

(b) a first rod disposed at said first end; and a second rod disposed at said second end;

(c) a plurality of holes disposed at said first end adjacent said first rod; and a second plurality of holes disposed at said second end adjacent said second rod;

(d) engaging means each said engaging means for engaging one of each of said plurality of holes said engaging means to fasten to one of each of said second plurality of holes to bear against said first and second rods to draw said opposed first and second ends toward one another and secure said rug about the step;

wherein first end is split into first and second bifurcated ends, and wherein second end is split into third and fourth bifurcated ends, wherein said plurality of holes are disposed in each of said first and second bifurcated ends, wherein said second plurality of holes are disposed in each of said third and fourth bifurcated ends, wherein said first rod is secured within a folded over section of said first and second bifurcated ends, wherein said second rod is secured within a second folded over section of said third and fourth bifurcated ends, and wherein said engaging means extends between said first and third bifurcated ends and said second and fourth bifurcated ends.

10. A wraparound rug as set forth in claim 9 wherein said engaging means comprises conventional tie wraps.

* * * * *